US008979092B2

(12) United States Patent
Kim

(10) Patent No.: US 8,979,092 B2
(45) Date of Patent: Mar. 17, 2015

(54) LUMINOUS DART BOARD SET

(76) Inventor: Yong Chul Kim, Gwangju-si (KR)

( * ) Notice: Subject to any disclaimer, the term of this patent is extended or adjusted under 35 U.S.C. 154(b) by 307 days.

(21) Appl. No.: 13/514,186

(22) PCT Filed: Dec. 3, 2010

(86) PCT No.: PCT/KR2010/008613

§ 371 (c)(1),
(2), (4) Date: Jun. 6, 2012

(87) PCT Pub. No.: WO2011/071274

PCT Pub. Date: Jun. 16, 2011

(65) Prior Publication Data

US 2012/0248702 A1 Oct. 4, 2012

(30) Foreign Application Priority Data

Dec. 7, 2009 (KR) ..... 10-2009-0120839

(51) Int. Cl.
*F41J 5/04* (2006.01)

(52) U.S. Cl.
USPC ..... 273/374

(58) Field of Classification Search
USPC ..... 273/374, 348.5; 463/9–31
See application file for complete search history.

(56) References Cited

U.S. PATENT DOCUMENTS 5,755,443 A * 5/1998 Huang ..... 273/371
5,971,397 A * 10/1999 Miguel et al. ..... 273/371
6,147,759 A * 11/2000 Simmons et al. ..... 356/623
7,163,204 B1 * 1/2007 Liao ..... 273/348.3
2004/0026863 A1 * 2/2004 Cho ..... 273/348.5
2009/0218769 A1 * 9/2009 Krzewicki et al. ..... 273/374
2009/0223682 A1 * 9/2009 Ramos ..... 169/46

FOREIGN PATENT DOCUMENTS

JP 61-085280 U 6/1986
JP 2001-509251 A 7/2001
KR 20-0267586 A 3/2002

OTHER PUBLICATIONS

Internationa Search Report RE PCT/KR2010/008613.

* cited by examiner

*Primary Examiner* — Masud Ahmed
(74) *Attorney, Agent, or Firm* — Maxon IP, LLC; Justin H. Kim

(57) ABSTRACT

Disclosed is a luminous dart board set. The luminous dart board set comprises: a dart pin (10) including a magnet (11) at the front portion thereof; a dart board (20) made of either an iron plate or an iron rubber sheet and including a printed matter (22) having a printing pattern (21) on the front surface thereof; a body (30) including a fixing part (32) coupled to a bottom surface of the dart board (20) and outwardly bent along the circumference thereof, and a reinforcement part (33) perpendicularly bent in a direction extending away from the fixing part (32); a rim cover (50) including a cover part (51) bent along the circumference of the body (30) so as to cover the front surface of the circumference of the body (30), and a floodlight space (52) spaced apart from the cover part (51); LED parts (70) disposed on the inner face of the rim cover (50) so as to emit light toward the floodlight space (52); and a fluorescent pigment, a phosphorescent pigment, and/or a mixture of the fluorescent pigment and the phosphorescent pigment which is added to the dart pin (10), the rim cover (50), and the printed matter (22).

16 Claims, 23 Drawing Sheets

LUMINOUS DART BOARD SET

TECHNICAL FIELD

The present invention relates to a luminous dart board set.

BACKGROUND ART

A dart board set generally includes a circular dart board and a dart pin thrown at the dart board, and is a game board for scoring according to the position of the dart pin stuck into the dart board when a player throws the dart pin toward the front face of the dart board.

Conventionally, the dart pin includes a sharp pin, which is made of a metal material and is disposed at the front side, and the dart board is made of soft cork so that the dart pin can be stuck into the dart board, and hence, the conventional dart board set has a problem in that the front face of the dart board is gradually damaged by the dart pin because holes are formed at portions where the dart pin is stuck in the case that the dart board set is well-used.

Accordingly, recently, dart board sets including a dart pin having a magnet embedded in the front side of the dart pin and a dart board having an iron plate or an iron rubber sheet attached to the front face thereof have been disclosed. Such dart board sets can prevent the dart board from being damaged even though it is used for a long time and prevent players from being injured by the sharp dart pin.

Such a dart board set having the magnetic dart pin includes: a circular dart board of an iron plate or an iron rubber sheet having concentric scoring sections indicated on the front face thereof; and a dart pin having a magnet embedded at the front side thereof so that the dart pin is attached to the front face of the dart board. Accordingly, the player can enjoy a dart game while scoring according to positions of the dart pin thrown at the dart board when the player throws the dart pin having the magnet at the magnet.

However, such a magnetic dart board has a problem in that the player cannot easily find the position of the dart board, at which the dart pin will be thrown, in a dark environment such as underground cafes because the dart board is generally installed on the surface of a wall.

Moreover, in order to prevent such a phenomenon, because illumination must be additionally installed on the surface of the wall where the dart board is installed, such a magnetic dart board has another problem in that it incurs expenses for installing lighting and in that it wastes electric power because the illumination must be always turned on.

Furthermore, the magnetic dart board has additional problems in that it is not significantly different from the dart board set having the sharp dart pin besides that the dart pin having the magnet can be attached to the dart board, and in that it is reduced in consumability and marketability because it is nearly permanently usable once being purchased.

Additionally, the conventional magnetic dart board set has no interior design effect because it has no additional function besides a game tool for a dart game.

In addition, the magnetic dart board set can easily show a printed matter for advertisement due to the nature of its structure in the case that it is used as promotional materials for advertisement, but has another problem in that the cost per unit is increased and an aesthetic effect is reduced in the case that an EL sheet or other luminous means is used because self-glowing of an advertising slogan or the printed matter for advertising is essential in a dark space.

DISCLOSURE

Technical Problem

Accordingly, the present invention has been made in an effort to solve the above-mentioned problems occurring in the prior arts, and it is an object of the present invention to provide a luminous dart board set, which enables a player to easily see a position of a magnetic dart pin stuck into a dart board and a printed matter printed on the dart board with the naked eyes even in a dark place when the player throws the magnetic dart pin at the dart board.

Moreover, it is another object of the present invention to provide a luminous dart board set, which can provide an aesthetic interior design effect by a dart board body and a rim cover that stand out by LED parts, and which can provide a promoting effect of goods or an advertiser because various promotional materials printed on the front surface of the dart board stand out by the LED parts.

Technical Solution

To achieve the above objects, the present invention provides a luminous dart board set.

In an aspect of the present invention, there is a luminous dart board set including: a dart pin having a magnet embedded in the front portion thereof; a dart board made of either an iron plate or an iron rubber sheet and including a printed matter having a printing pattern on the front surface thereof; a body including a fixing part coupled to a bottom surface of the dart board and outwardly bent along the circumference thereof, and a reinforcement part perpendicularly bent in an outward direction of the fixing part; a rim cover including a cover part bent along the circumference of the body so as to cover the front surface of the circumference of the body, and a floodlight space spaced apart from the cover part; LED parts disposed on the inner face of the rim cover so as to emit light toward the floodlight space; and a fluorescent pigment, a phosphorescent pigment, and/or a mixture of the fluorescent pigment and the phosphorescent pigment which is added to at least one of the dart pin, the rim cover, and the printed matter.

The luminous dart board set further includes a shock absorbing plate mounted between the lower face of the printed matter and the upper face of the body.

Moreover, width of the fixing part of the body is wider than width of the rim cover mounted along the circumference of the body, so that a circular light-emitting band is formed by light of the LED parts emitted through the floodlight space formed by the rim cover along width of the fixing part of the body, which is wider than the width of the rim cover.

Furthermore, the luminous dart board set further includes: a scoring sheet disposed between the dart board and the printing pattern for sensing pressure of the dart pin attached to the dart board; a printed circuit board electrically connected with the scoring sheet; and a display part electrically connected with the printed circuit board.

Additionally, the scoring sheet includes: a first electric current sheet having first electric current wires printed thereon and respectively concentrically sectioned; and a second electric current sheet having second electric current wires, which are printed thereon and respectively radially sectioned, the second electric current sheet sensing an electric connection of each section formed by the first electric current sheet and the second electric current sheet crossing each other.

In addition, the printed circuit board further includes a microprocessor for calculating a previously set score value corresponding to each section of the scoring sheet and sending the calculated score value to the display part.

Moreover, the first electric current sheet of the scoring sheet includes first to fourth score sections respectively having different scores, and each score section is electrically connected with the other score sections, which have the same score, in a row. The second electric current sheet of the scoring sheet includes first to fourth grounding sections, which are grounded at positions corresponding to the first to fourth score sections of the first electric current sheet by pressure, and each grounding section is electrically connected with the other grounding sections, which have the same score, in a row, and the second electric current sheet has the same arrangement as the first electric current sheet. Accordingly, a score is detected by an electric connection between the first to fourth score sections and the first to fourth grounding sections.

Furthermore, the first scoring section and the third scoring section of the first electric current sheet are electrically connected with each other by a first detection wire, and the second scoring section and the fourth scoring section of the first electric current sheet are electrically connected with each other by a second detection wire.

Additionally, the first grounding section and the second grounding section of the second electric current sheet are electrically connected with each other by a third detection wire, and the third grounding section and the fourth grounding section are electrically connected with each other by a fourth detection wire.

In another aspect of the present invention, there is a luminous dart board set including: a dart pin having a plastic needle of a sharp tip screw-coupled to the front portion thereof; and a dart board including: a rim cover having a floodlight space; a number board assembled inside the rim cover; a segment receiving board mounted inside the number board and having a plurality of receiving spaces; a plurality of segments received in each of the sectioned receiving spaces of the segment receiving board and each having a needle hole to which the plastic needle of the dart pin is stuck in a width direction; and a rear cover arranged at the rear of the segment receiving board, wherein LED parts, which emit light toward the floodlight space of the rim cover, are arranged on the inner face of the rim cover in a circular form and face the center of the dart board.

Moreover, at least one of a fluorescent pigment, a phosphorescent pigment, and a mixture of the fluorescent pigment and the phosphorescent pigment is added to at least one of the dart pin, the rim cover, the number board, the segment receiving board, and the segments.

Furthermore, the luminous dart board set further includes a shock absorbing plate mounted on an inner face in corresponding to the segments of the rear cover.

Additionally, the luminous dart board set further includes: a scoring sheet disposed between the segments and the rear cover for sensing shock generated when the dart pin is stuck into the needle hole of the segment and producing a score; a printed circuit board electrically connected with the scoring sheet; and a display part electrically connected with the printed circuit board.

In addition, the printed circuit board further includes a microprocessor for calculating a previously set score value corresponding to each section of the scoring sheet and sending the calculated score value to the display part.

Furthermore, the luminous dart board set further includes: a stand on which the dart board is mounted; a monitor mounted above the dart board of the stand for outputting a dart score; and a manipulation button mounted under the dart board of the stand for allowing reset or ON/OFF modes of the monitor; and a speaker mounted under the manipulation button.

Additionally, the sectioned spaces of the segment receiving board are concentrically and/or radially sectioned into equal parts.

Advantageous Effects

The luminous dart board set according to the present invention can obtain a good interior design effect in a dark space by illumination emitted by the LED parts mounted inside the body and the rim cover disposed along the circumference of the front face of the body.

Moreover, because the fluorescent pigment is impregnated in the dart pin, people can easily see the position of the dart pin attached to the dart board even in the dark space and feel an aesthetic sense.

Furthermore, the dart pin self-glows by light emitted by the LED parts, and hence, the dart board set provides a luminous effect at the portion where the dart pin is attached.

Additionally, because the circular light-emitting band is formed between the body and the rim cover, the present invention can provide an aesthetic sense and an interior design effect as well as be used as a game tool.

In addition, because various kinds of promotional words, logos or product names expressed on the printed matter on the front surface of the dart board, to which the dart pin is attached, are expressed with the fluorescent pigment or the phosphorescent pigment, it can maximize an advertising effect of the manufacturer through a self-glowing effect of the printed matter.

Moreover, because a dart score produced when a player throws the dart pin is automatically calculated by the scoring sheet and displayed on the display part, people can easily see the score even in the dark place, and hence, it enhances gameability and usability because there is no need to sum up the scores manually.

Furthermore, the present invention remarkably simplifies the key matrix structure because the sections of the same score on the scoring sheet are electrically connected in a row, and hence, it reduces a defect rate in operation and also reduces the price.

Additionally, the present invention can output the dart scores in a voice-operated manner, and hence, it provides persons, who are visually handicapped, with convenience.

MODE FOR INVENTION

Figure 1:
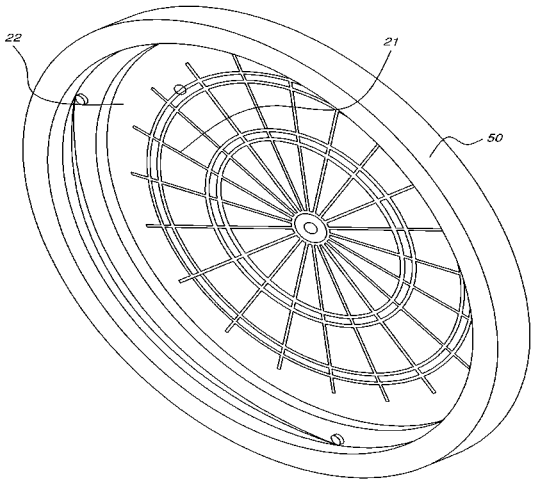
FIG. 1 is a perspective view of a luminous dart board set according to a first preferred embodiment of the present invention.
Figure 2:
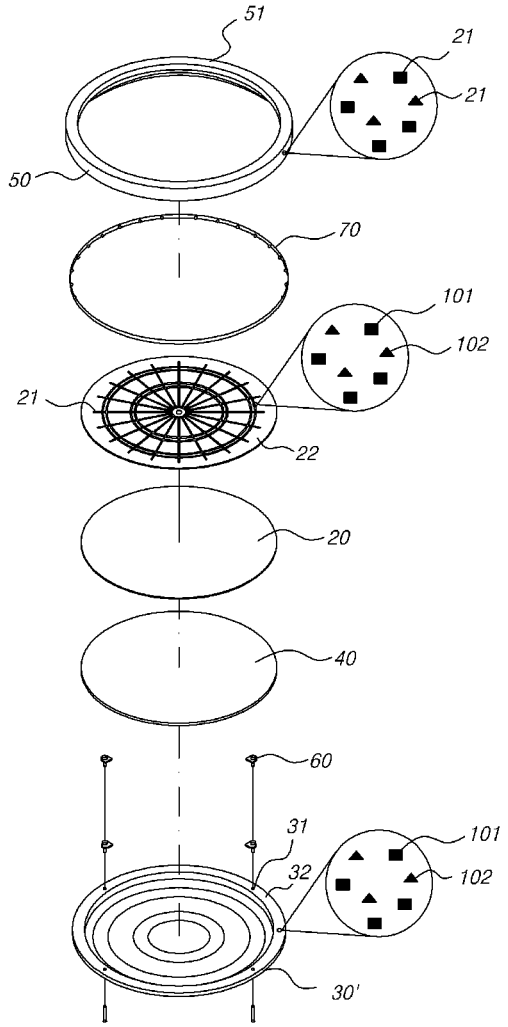
FIG. 2 is an exploded perspective view showing a structure of the luminous dart board set according to the first preferred embodiment of the present invention.

Description will now be made in detail of preferred embodiments of the present invention with reference to the attached drawings. It will be understood by those skilled in the art that the embodiments described in the specification are merely exemplary and the present invention is not limited. Therefore, a person skilled in the art can perform various changes and modifications based on a principle of the present invention. In the specification of the present invention, the terms, 'and/or' means that at least one of components listed at the front and the rear is included. It will be understood that the expression, 'located on' in the specification and claims implies not only that a component is directly located on another component but also that a third component may be additionally located on the component. In the present invention, the words 'first' and 'second' are used to designate each component or part of the present invention, but it will be understood that the words used in the specification and claims are used to clearly describe or explain the present invention and shall not be interpreted as the limited meanings. It will be also understood that thickness and relative thickness of components in the drawings may be exaggerated for clear description of the present invention. Moreover, matters illustrated in the drawings are schematized in order to describe or explain the embodiments of the present invention more easily, and hence, may be different from forms embodied actually.

First, referring to FIGS. 1 to 13, a luminous dart board set according to a first preferred embodiment of the present invention will be described.

As illustrated in the drawings, the luminous dart board set includes a fluorescent dart pin 10, a dart board 20 to which the dart pin 10 is attached, a body 30, a shock-absorbing plate 40, a rim cover 50, and LED parts 70.

Figure 3:
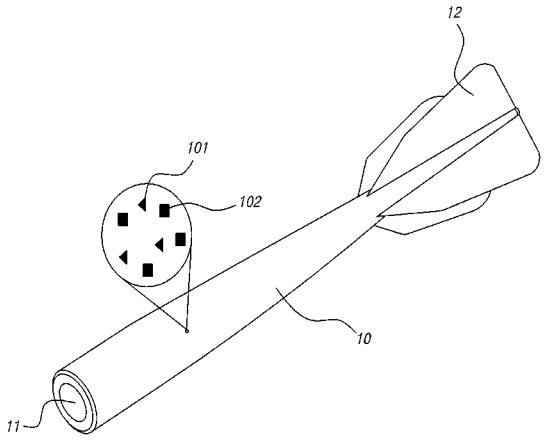
FIG. 3 is a perspective view of a fluorescent dart pin, which is one of essential parts of the luminous dart board set according to the first preferred embodiment.
Figure 4:
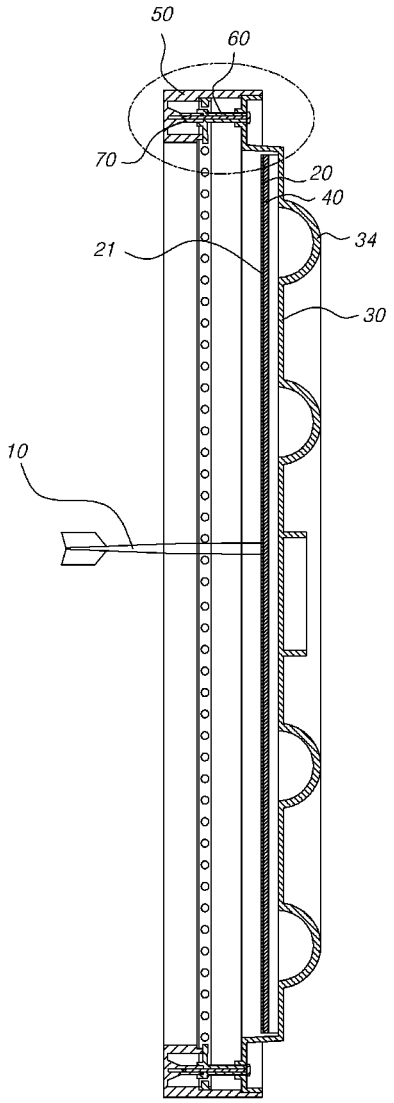
FIG. 4 is a sectional view showing the structure of the luminous dart board set according to the first preferred embodiment.
Figure 5:
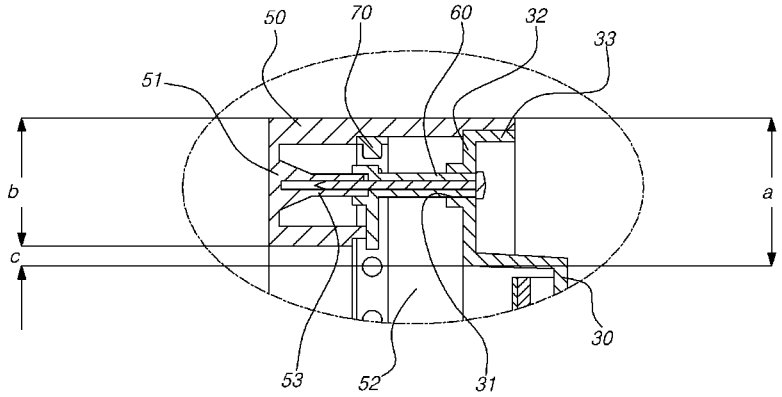
FIG. 5 is an enlarged view showing essential parts of the luminous dart board set according to the first preferred embodiment.

As shown in FIG. 3, the dart pin 10 includes a magnet 11 embedded in a front face thereof, a fluorescent pigment 101 impregnated therein, and dart wings 12 formed integrally with the dart pin 10.

When the fluorescent dart pin 10 is attached onto the front surface of the dart board 20 by light emitted through the LED parts 70, it produces a luminous effect, and hence, a player can easily see the position of the dart pin 10 attached to the dart board 20 even though there is no illumination in a dark space.

Moreover, due to the light emitting function of the dart pin 10, because light is emitted toward a printing pattern 21 expressed on a front surface of the dart board 20, to which the dart pin 10 is attached, it provides an effect that a printed matter of the dart board, to which the dart pin 10 is attached, stand out visually.

The dart board 20 is made with an iron plate or an iron rubber sheet and includes a printed matter 22 having a printing pattern 21 on the front surface thereof.

The dart board 20 is generally formed in a circular shape and is magnetized in such a fashion that the magnet 11 embedded in the front side of the fluorescent dart pin 10 is thrown at the dart board 20 and attached to the dart board 20 by its magnetism.

The printed matter 22 adhered on the front surface of the dart board 20 is made of paper or synthetic resin.

The printing pattern 21 shown on the printed matter 22 is promotional materials, such as darts, archery, advertising copies or product advertising words of the manufacturer, logos, or others, and the printing pattern 21 is printed with a fluorescent pigment 101 or a phosphorescent pigment 102 or printed with a fluorescent/phosphorescent pigment 102, in which the fluorescent pigment 101 and the phosphorescent pigment 102 are mixed, so that the printing pattern 21 emits light by the LED parts 70 or self-glows.

That is, in the case that the printing pattern 21 shown on the front surface of the printed matter 22 is printed with the fluorescent pigment 101, the printing pattern 21 glows by light emitted through the LED parts 70. In the case that the printing pattern 21 is printed with the phosphorescent pigment 102, the printing pattern 21 self-glows by the phosphorescent pigment 102, which receives and stores light, even though the LED parts 70 do not emit light, and hence, the luminous effect is kept for a predetermined period of time even after lights-out.

Therefore, the luminous dart board set according to the present invention can provide a good visual effect in such a fashion that dart players or people, who watch dart games, can feel beauty and an aesthetic sense through the luminous printing pattern 21 of the printed matter 22, and enhance promotion and advertisement effects of the manufacturer or the product because the luminous printing pattern 21 glows even in the dark space.

The body 30 includes: a fixing part 32 which is coupled to a bottom surface of the dart board 20 and outwardly bent along the circumference thereof and has a projecting coupling hole 31 formed on the inner face thereof; and a reinforcement part 33 perpendicularly bent in an outward direction of the fixing part 32.

Furthermore, the body 30 may further include a protrusion 34 protrudingly formed on a lower portion thereof. The protrusion 34 may be in a double array structure of a circular band type formed from a lower face of the body 30 and have the same thickness as the body 30.

When the protrusion 34 is formed as described above, it can prevent the body 30 from being bent when the body 30 is injection-molded, and hence, a defect rate is minimized while the injection-molding of the body 30.

For instance, in the case that the protrusion 34 is not formed, the body 30 is formed in a circular flat plate shape, and hence, ability to cope with tensile strength or compressive stress generated during the injection-molding is decreased, and hence, the body may be bent during the injection-molding.

Accordingly, the defect rate of the body is increased due to an error generated while the components of the luminous dart board set are assembled, but the protrusion 34 formed on the lower portion of the body 30 can solve the problem occurring while the injection-molding of the body.

The shock-absorbing plate 40 is located between the dart board 20 and the front surface of the body 30 in order to absorb flexibility of the dart pin 10 attached to the dart board 20, and it is preferable that the shock-absorbing plate 40 is made of sponge, which is rapidly restored in shape.

As described above, because the shock-absorbing plate 40 is located between the dart board 20 and the body 30, shock and noise generated when the dart pin 10 is thrown at the front surface of the dart board 20 can be absorbed, and it prevents the dart pin 10 from not being attached to the dart board 20 and dropping down by repulsive power generated when the dart pin 10 is bumped against the dart board 20.

The rim cover 50 includes: a cover part 51 bent along the circumference of the body 30 so as to cover the front surface of the circumference of the body 30; a floodlight space 52 spaced apart from the cover part; and a fixing projection 53 projecting from the inner face thereof at a position corresponding to the projecting coupling hole 31 of the fixing part 32 of the body 30.

Additionally, the rim cover 50 may include a fluorescent pigment 101, and the rim cover 50, in which the fluorescent pigment is impregnated, glows by light emitted through the LED parts 70.

The rim cover 50 is mounted on the front surface of the circumference of the body 30 in a state where the front surface of the circumference of the body 30 is spaced apart from the cover part 51 of the rim cover 50 at a predetermined interval, so that the floodlight space 52 can be naturally formed between the cover part 51 and the circumference of the body 30.

The floodlight space 52 can be formed through the steps of fitting the fixing projection 53, which is formed on the inner face of the rim cover 50, to the projecting coupling hole 31 of the body 30 and fastening it with a piece 61. In this instance, when a support bracket 60 is interposed between the projecting coupling hole 31 and the fixing projection 53, the floodlight space 52 becomes widened, and hence, the printed pattern looks brighter.

Moreover, because the reinforcement part 33 perpendicularly bent in the outward direction of the fixing part 32 of the body 30 is in close contact with the rim cover 50, combination between the body 30 and the rim cover 50 is enhanced.

The LED parts 70 are disposed on the inner face of the rim cover 50 to emit light toward the floodlight space 52 of the rim cover 50.

Each of the LED parts 70 generally includes light emitting diodes and a printed circuit board to which the light emitting diodes are electrically connected, and the diodes may be chip-type diodes or ball-type diodes.

The LED parts 70 are connected in a band type along the inner circumference of the cover part 51 of the rim cover 50, and the rim cover 50, the body 30, the dart pin 10 and the printing pattern 21 shown on the printed matter 22 glow by light emitted through the LED parts 70.

In other words, light emitted through the LED parts 70 is irradiated from the floodlight space 52 formed between the rim cover 50 and the body 30 and influences on the printed matter 22 of the dart board 20 formed on the front surface of the body as well as on the body 30, and hence, the dart pin 10 attached to the dart board and the printing pattern 21 of the printed matter 22 also glow.

Accordingly, when the LED parts 70 are turned on, the rim cover 50, because the body 30 and the printing pattern 21 of the printed matter 22 glow, it produces a good visual image and an aesthetic sense and provides an interior design effect.

Furthermore, the printing pattern 21 of the printed matter glows in a state where the wavelengths of light emitted through the LED parts 70 are overlapped, and hence, it highlights images or words expressed on the printing pattern 21 to thereby enhance the visual effect.

The light emitting diodes of the LED parts 70 have power consumption ranging from 0.1 W to 0.5 W and the number of the light emitting diodes ranges 10 to 100, but the number of the light emitting diodes is not restricted thereto.

Light emitted from the light emitting diodes of the LED parts 70 may include white light or green light.

In this instance, the white light or the green light emitted through the LED parts 70 is in the optimal luminous condition when it is reflected to the rim cover 50, the printing pattern 21 of the printed matter 22, and the dart pin 10, in which the fluorescent pigment 101 or the phosphorescent pigment 102 are selectively impregnated, and hence, the players and the people, who watch the dart game, can feel an enhanced aesthetic sense and beauty.

The luminous dart board set according to the present invention can provide unique light-emitting effect and illumination effect because the fluorescent pigment 101, the phosphorescent pigment 102, and mixture of the fluorescent pigment 101 and the phosphorescent pigment 102 are selectively used to the rim cover 50, the printing pattern 21 of the printed matter 22, and the dart pin 10.

Additionally, in the luminous dart board set according to the present invention, width (a) of the fixing part 32 of the body 30 is wider than width (b) of the rim cover 50 mounted along the circumference of the body 30.

Figure 6:
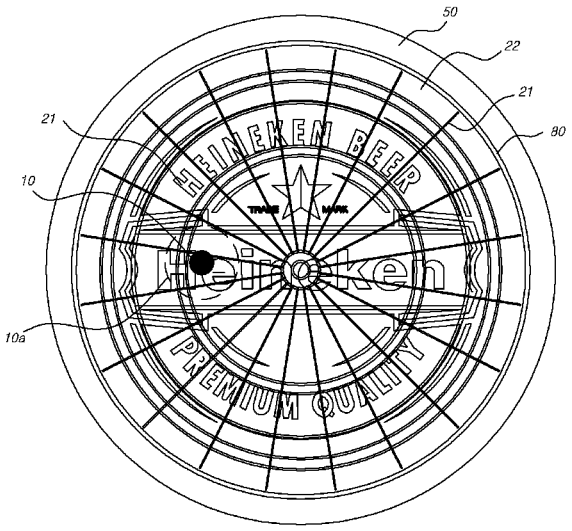
FIG. 6 is a front view showing a structure of a luminous dart board set according to a second preferred embodiment of the present invention.

Accordingly, as shown in FIG. 6, a circular light-emitting band 80 is formed by light of the LED parts 70 emitted through the floodlight space 52 formed by the rim cover 50 along width (c) of the fixing part 32 of the body 30, which is wider than the width (b) of the rim cover 50.

Because the light of the LED parts 70 emitted through the floodlight space 52 is irradiated toward the width (c) of the fixing part 32 of the body 30, which is wider than the width (b) of the rim cover 50, the circular light-emitting band 80 is naturally formed along the width (c) of the fixing part 32, and hence, it enhances beauty and the aesthetic sense of the outward appearance of the luminous dart board set and highlights the good visual image in interior design.

Moreover, when a player throws the dart pin 10 away and the dart pin 10 is attached to the dart board 20, as shown in FIG. 6, a luminous zone 10*a* is formed around the dart pin 10 by light emitted through the dart pin 10 toward the printing pattern 21 shown on the front surface of the dart board 20, to which the dart pin 10 is attached, and hence, it provides an illumination effect that light is emitted to the printing pattern 21 and printed matters around the dart pin 10 can be highlighted visually.

Figure 7:
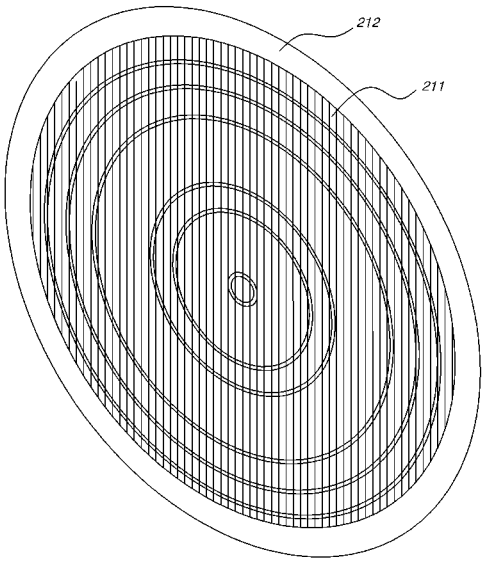
FIGS. 7 to 9 are views showing a structure of a luminous dart board set according to a third preferred embodiment of the present invention.
Figure 8:
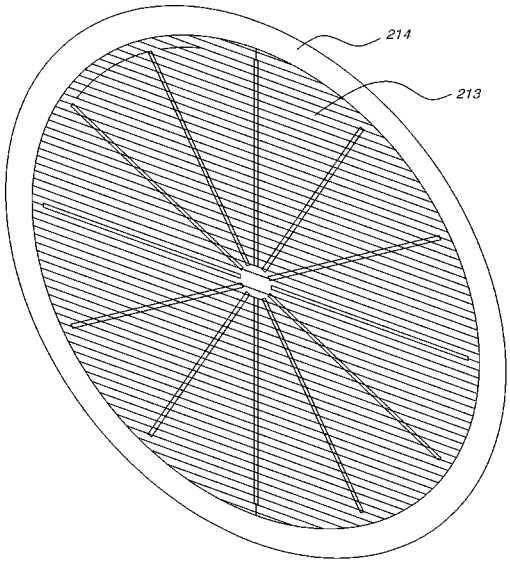
Figure 9:
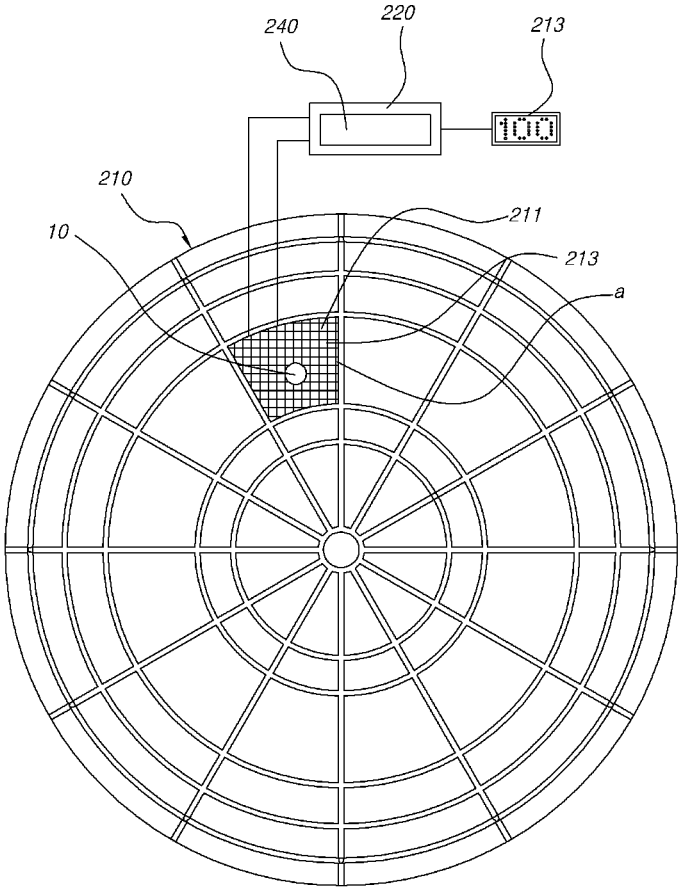
Figure 10:
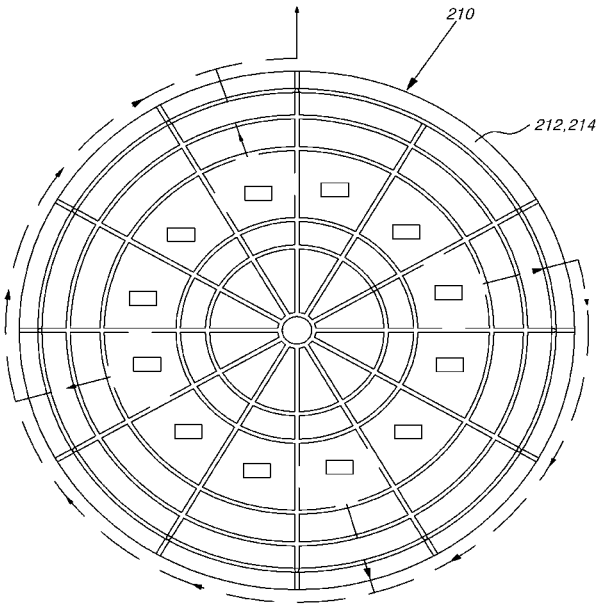
FIGS. 10 to 13 are views showing a structure of a luminous dart board set according to a fourth preferred embodiment of the present invention.
Figure 11:
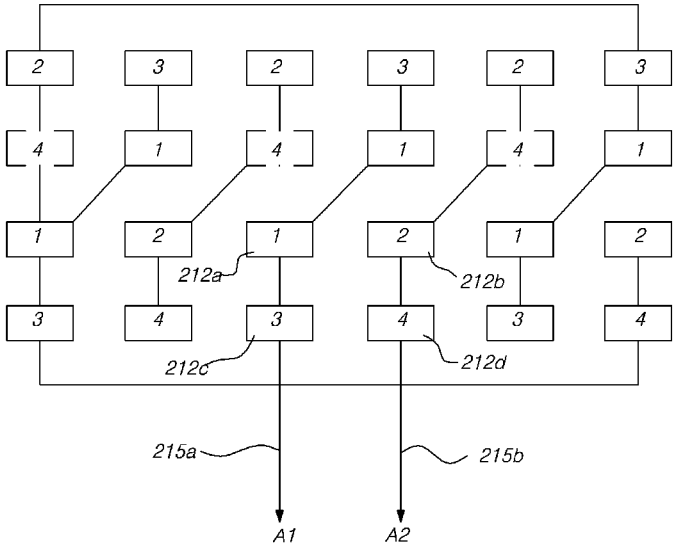
Figure 12:
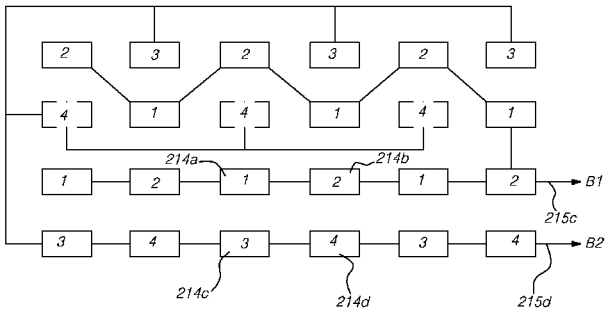

FIGS. 7 to 9 illustrate a luminous dart board set according to a second preferred embodiment of the present invention.

As shown in the drawings, the luminous dart board set further includes: a scoring sheet 210 disposed between the dart board 20 and the printing pattern 21 for sensing the dart pin 10 attached to the dart board 20; a printed circuit board 220 electrically connected with the scoring sheet 210; and a display part 230 electrically connected with the printed circuit board 220.

The scoring sheet 210 includes: a first electric current sheet 212 having first electric current wires 211 respectively printed thereon and respectively concentrically insulated and sectioned; and a second electric current sheet 214 having second electric current wires 212, which are printed thereon and respectively radially insulated and sectioned, the second electric current sheet 214 being piled up with the first electric current sheet 212.

The scoring sheet 210 may have a film type membrane switch, or may be applied to all means which is switched by shock generated when the dart pin is attached to the dart board.

Moreover, the printed circuit board 220 further includes a microprocessor 240 for calculating a score value set at a position which is charged with electricity by pressure of the dart pin 10 sensed on the scoring sheet 210 and sending the calculated score value to the display part 230.

When the dart pin 10 thrown by a player is attached to any one point where the first electric current wire 211 of the first electric current sheet 212 and the second electric current wire 213 of the second electric current sheet 214 of the scoring sheet 210 cross each other, the first electric current wire 211 and the second electric current wire 213 get in contact with each other at the point where the dart pin 10 is attached, and hence, the score value of the contact point is transferred to the printed circuit board 220, to which the first electric current wire 211 of the first electric current sheet 212 and the second electric current wire 212 of the second electric current sheet 214 are electrically connected.

Because information on scores corresponding to the combination of the sectioned first and second electric current wires 211 and 213 is set in advance, a score value corresponding to a zone (a) located at the point where the dart pin 10 thrown by the player is attached is calculated by the microprocessor 240 of the printed circuit board 220, and it is displayed through the display part 230.

FIGS. 10 to 13 illustrate a luminous dart board set according to a third preferred embodiment of the present invention.

In general, a scoring zone of the dart board set has a predetermined pattern, and the same scoring zone is connected in a row with one wire.

As shown in the drawings, the first electric current sheet 212 of the scoring sheet 210 includes first to fourth score sections 212*a*, 212*b*, 212*c* and 212*d* respectively having different scores, and each score section is electrically connected with the other score sections, which have the same score, in a row.

The second electric current sheet 214 of the scoring sheet 210 includes first to fourth grounding sections 214*a*, 214*b*, 214*c* and 214*d*, which are located at positions corresponding to the first to fourth score sections 212*a*, 212*b*, 212*c* and 212*d* of the first electric current sheet 212 and are grounded by pressure.

Each of the grounding sections is electrically connected with the plural grounding sections having the same score in a row, and has the same arrangement as the first electric current sheet 212, and hence, a score is detected by the electric connection between the first to fourth scoring sections 212*a*, 212*b*, 212*c* and 212*d* and the first to fourth grounding sections 214*a*, 214*b*, 214*c* and 214*d*.

The first scoring section 212*a* and the third scoring section 212*c* of the first electric current sheet 212 are electrically connected with each other by a first detection wire 215*a*, and the second scoring section 212*b* and the fourth scoring section 212*d* of the first electric current sheet 212 are electrically connected with each other by a second detection wire 215*b*.

Additionally, the first grounding section 214*a* and the second grounding section 214*b* of the second electric current sheet 214 are electrically connected with each other by a third detection wire 215*c*, and the third grounding section 214*c* and the fourth grounding section 214*d* are electrically connected with each other by a fourth detection wire 215*d*.

When the dart pin is attached to one of the first to fourth scoring sections 212*a*, 212*b*, 212*c* and 212*d* electrically connected to the first electric current sheet 212, one of the first to fourth grounding sections 214*a*, 214*b*, 214*c* and 214*d* grounded with the first to fourth scoring sections 212*a*, 212*b*, 212*c* and 212*d* is grounded with the scoring section located at the position where the dart pin is attached, and a ground signal is detected through one of the first to fourth detection wires 215*a*, 215*b*, 215*c* and 215*d*.

Figure 13:
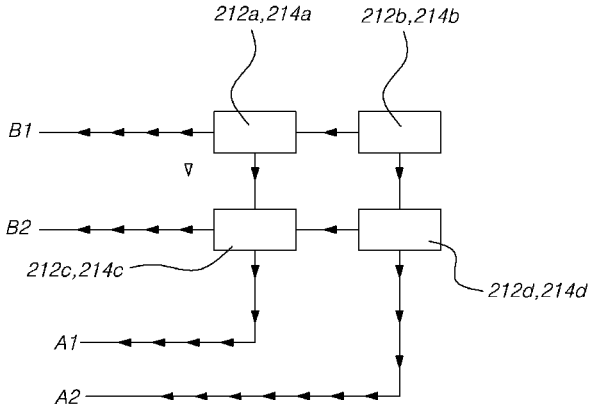
Figure 14:
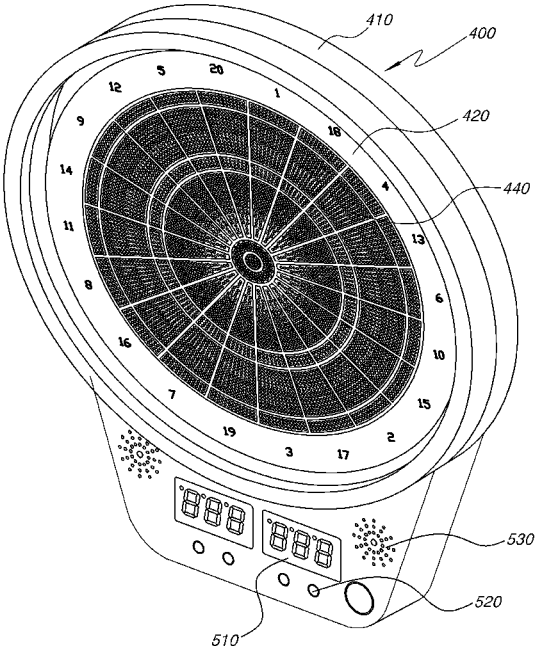
FIG. 14 is a perspective view of the luminous dart board set according to the second preferred embodiment.
Figure 15:
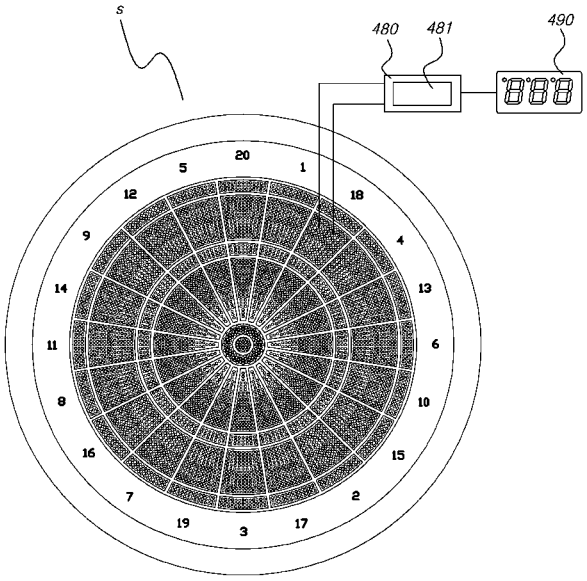
FIG. 15 is a front view of the luminous dart board set according to the second preferred embodiment.
Figure 16:
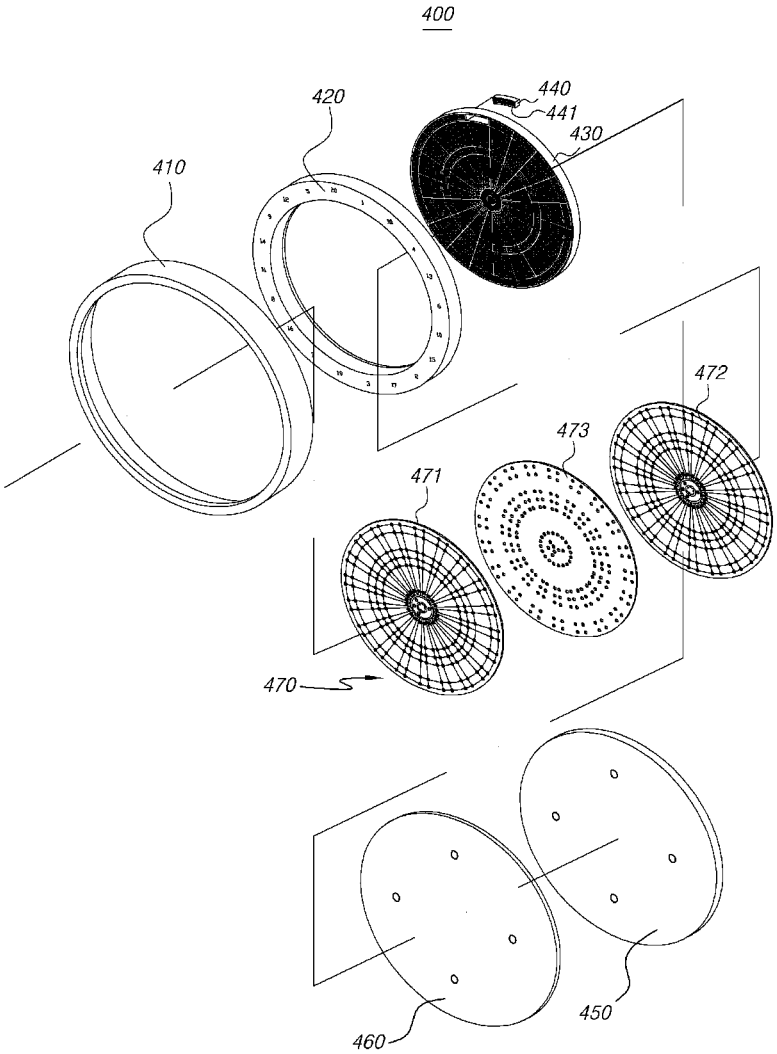
FIG. 16 is an exploded perspective view of the luminous dart board set according to the second preferred embodiment.
Figure 17:
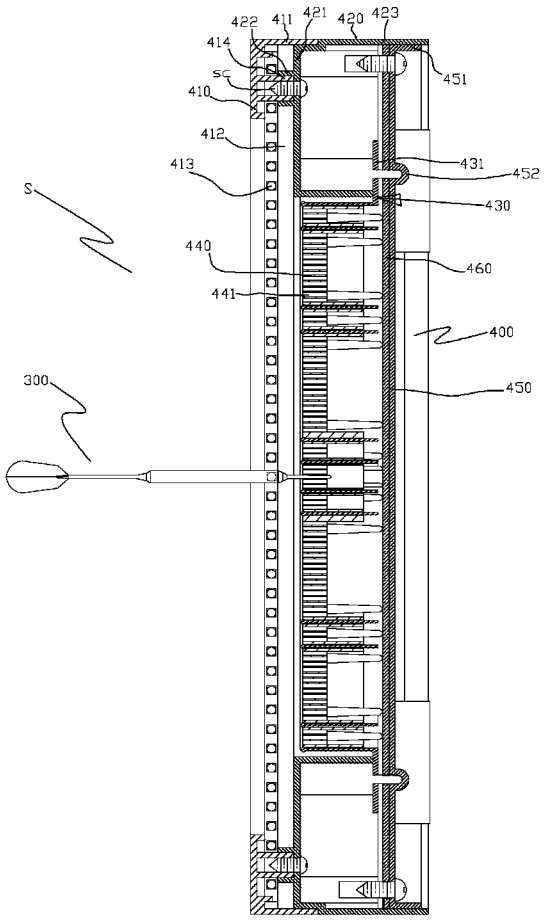
FIG. 17 is a vertically sectional view of the luminous dart board set according to the second preferred embodiment.
Figure 18:
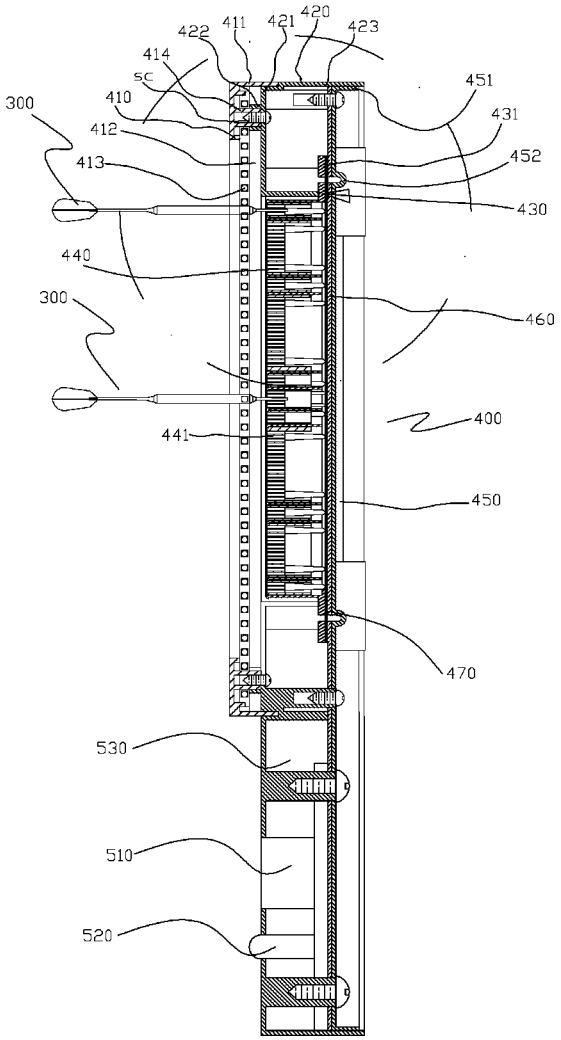
FIG. 18 is a vertically sectional view of FIG. 1.
Figure 19:
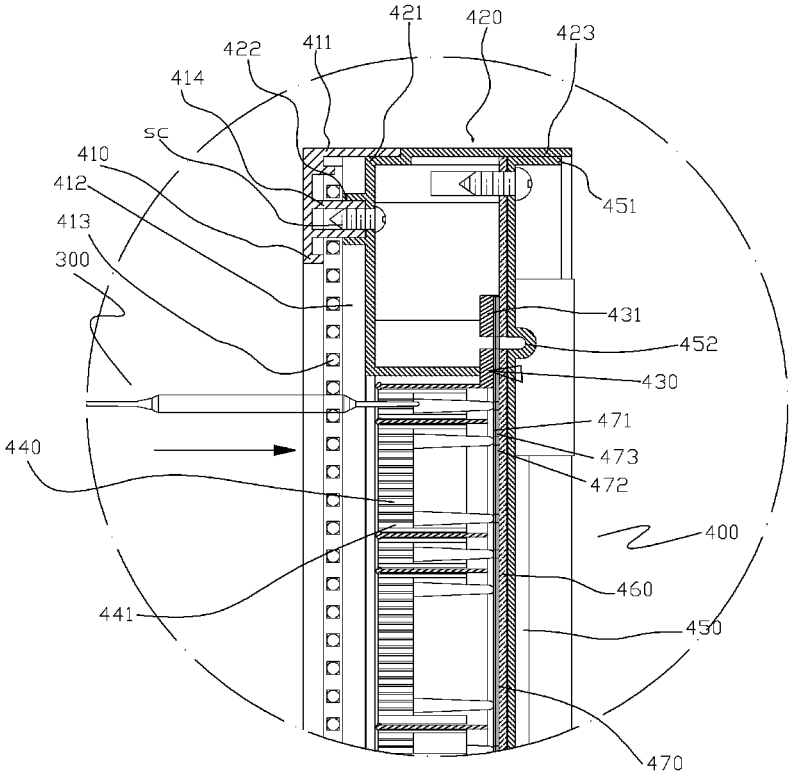
FIG. 19 is a partially enlarged view of FIG. 18.
Figure 20:
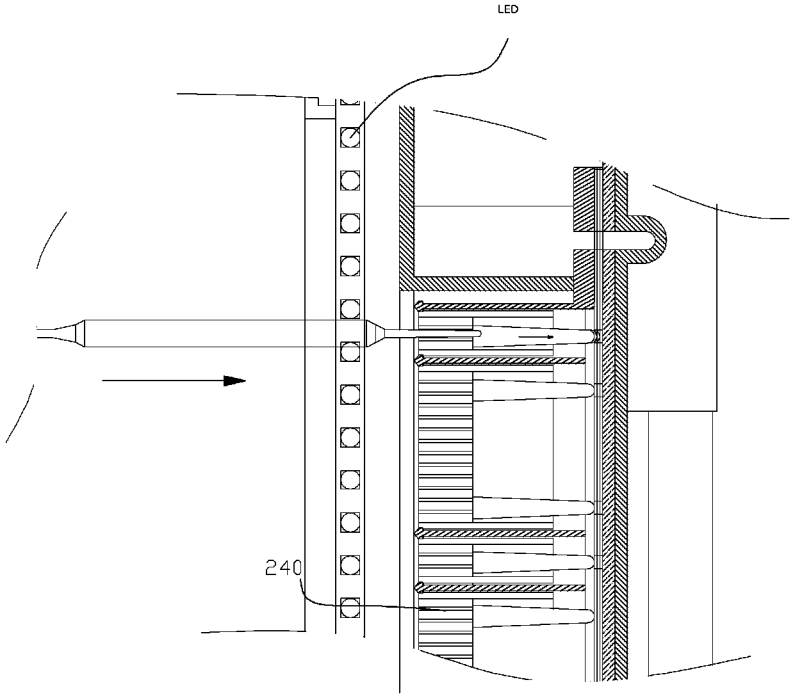
FIG. 20 is an enlarged view of FIG. 19.
Figure 21:
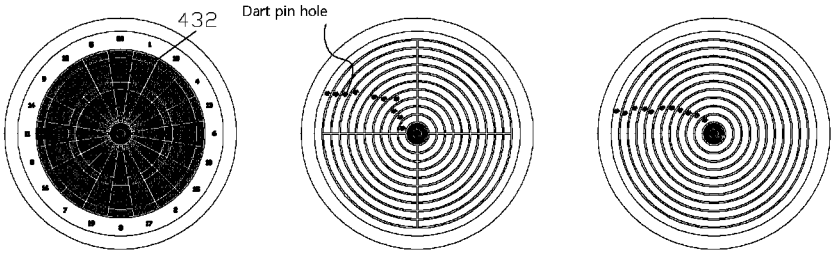
FIGS. 21 to 25 illustrate examples of various forms of the luminous dart board set according to the present invention.
Figure 22:
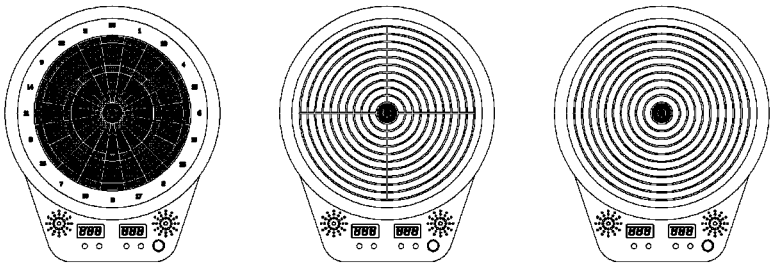
Figure 23:
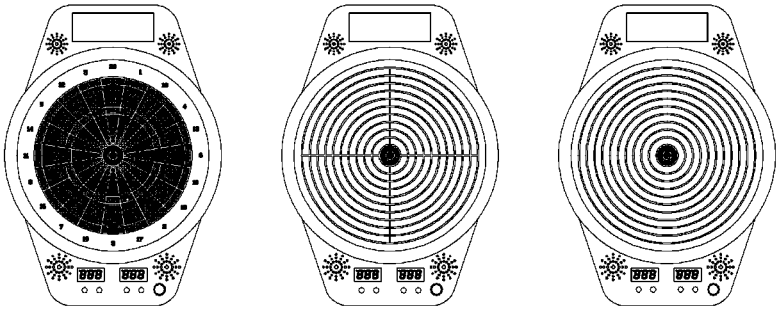
Figure 24:
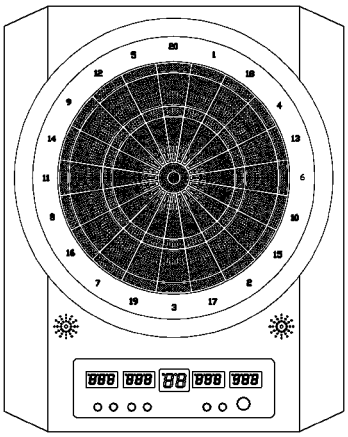
Figure 25:
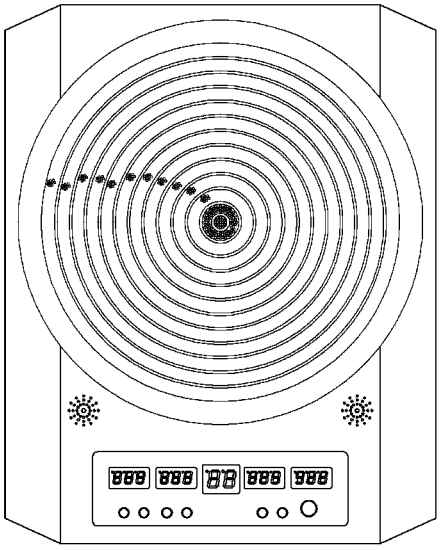

For instance, referring to FIG. 13, how to detect one score will be described. When the dart pin is attached to the first scoring section 212*a* of the first electric current sheet 212, which has one point, the first scoring section 212*a* is grounded with the first grounding section 214*a* of the second electric current sheet 214, and detection signals of the first detection wire 215*a* electrically connected with the first scoring section 212*a* and the third detection wire 215*c* electrically connected with the first grounding section 214*a* are transferred to the printed circuit board 220, and hence, as shown in FIG. 13, the previously set 'one score' corresponding to a key matrix combination (A1 and B2) of 'A1' of the first detection wire 215*a* and 'B1' of the second detection wire 215*b* is displayed on the display part.

According to the above structure, when the dart pin is attached to each scoring section, because the score corresponding to coordinate values of each scoring section to which the dart pin is attached and each grounding section which is grounded with the scoring section is displayed, the player can see the score displayed on the display part 220 with the naked eyes to check his or her rank.

Next, referring to FIGS. 14 to 29, a luminous dart board set according to a fourth preferred embodiment of the present invention will be described.

As shown in FIGS. 14 to 29, the luminous dart board set S according to the fourth preferred embodiment of the present invention includes a dart board 400 and a dart pin 300.

The dart board 400 is made of metal or synthetic resin, and is generally in a circular shape, but the front face of the dart board 400 is not restricted to the circular shape and may adopt one of various shapes, for instance, a polygonal shape.

Here, the dart board 400 may have a promotional printed matter on the front surface thereof (not shown).

The dart board 400 includes a rim cover 410 having LED parts 413, a number board 420, a segment receiving board 430, a segment 440, and a rear cover 450.

The rim cover 410 is formed on the circumference of the front surface of the dart board 400, and mounted on the circumference of the number board 420. Such a rim cover 410 includes a cover part 411 bent to surround the circumference of the number board 420 and a floodlight space 412 inwardly spaced apart from the cover part 411.

Moreover, the rim cover 410 is mounted on the front surface of the circumference of the number board 420 in a state where the circumference of the number board 420 is spaced apart from the cover part 411 of the rim cover 410 at a predetermined interval, and hence, the floodlight space 412 is naturally formed between the cover part 411 and the circumference of the number board 420.

Furthermore, the rim cover 410 may contain one selected from a fluorescent pigment, a phosphorescent pigment, and a fluorescent/phosphorescent pigment, in which the fluorescent pigment and the phosphorescent pigment are mixed, by impregnation, coating or other method, and in this instance, the rim cover 410 emits light or self-glows by light emitted through the LED parts 413.

Additionally, the rim cover 410 may further include a joining projection 414 forcedly fit to a projection joining part 422 of the number board 420, which will be described, at the rear part of the rim cover 410.

In addition, the LED parts 413 are mounted on the inner face of the rim cover 410 and are to emit light toward the floodlight space 412 of the rim cover 410. Each of the LED parts 413 generally includes light emitting diodes and a printed circuit board (not shown) electrically connected with the light emitting diodes. Here, the light emitting diodes may be one of chip type diodes and ball type diodes.

Such LED parts 413 are connected in a band type along the inner circumference of the cover part 411 of the rim cover 410, and hence, by the emitted light, pigments contained in the rim cover 410, the number board 420, the dart pin 400, the segment receiving board 430, and the segment 440 glow.

Additionally, because the light emitted through the LED parts 413 shines the components containing the pigments while being dispersed in various directions through the floodlight space 412 formed between the rim cover 410 and the number board 420, so that the luminous effect is enhanced and the interior design effect is also increased.

The light emitting diodes of the LED parts 413 have power consumption ranging from 0.1 W to 0.5 W and the number of the light emitting diodes ranges 10 to 100, but the number or arrangement of the light emitting diodes is not restricted thereto.

Moreover, light emitted from the light emitting diodes of the LED parts 413 may include white light or green light. In this instance, the white light or the green light emitted through the LED parts 413 is in the optimal luminous condition when it is reflected to the component, in which the fluorescent pigment or the phosphorescent pigment are selectively impregnated, and hence, the players and the people, who watch the dart game, can feel an enhanced aesthetic sense and beauty.

The number board 420 may contain one selected from a fluorescent pigment, a phosphorescent pigment, and a fluorescent/phosphorescent pigment, in which the fluorescent pigment and the phosphorescent pigment are mixed, by impregnation, coating or other method, and in this instance, the rim cover 410 emits light or self-glows by light emitted through the LED parts 413 mounted along the inner circumference thereof.

The number board 420 is arranged at the rear of the rim cover 410, and includes: a fixing part 421 disposed on the front face thereof and having a plurality of projection joining parts 422; and a reinforcement part 423 horizontally bent in an outward direction along the circumference of the fixing part 421.

In the meantime, the projection joining part 422 is assembled by insertion of the joining part 414 formed on the rear face of the rim cover 410. The longer the projection joining art 422 and the joining part 414 inserted into the projection joining part 422 are, the larger the floodlight space 412 is. However, if they are too long, because the joining of the joining parts is not stable, it is preferable to set a proper length.

Meanwhile, in order to join the rim cover 410 and the number board 420 together, the joining part 414 is inserted into the projection joining part 422, and then, a piece or a screw (sc) is fastened from the inward face of the number board 420 so as to join them.

Moreover, if width (a) of the fixing part 421 of the number board 420 is wider than a front face width (b) of the rim cover 410, a circular luminous band (not shown) is formed as much as a deviation width (c) between the width (a) of the fixing part and the front face width (b).

Accordingly, because the LED light emitted through the floodlight space 412 is radiated toward the width (a) of the fixing part 421 of the number board 220, which is wider than the front face width (b) of the rim cover 210, the circular luminous band is naturally formed along the width (a) of the fixing part 421, and hence, it enhances beauty and the aesthetic sense of the outward appearance of the luminous dart board set and highlights the good visual image in interior design.

Furthermore, as shown in FIG. 29, the LED parts 413 are circularly arranged in the band type inside the rim cover 410, and hence, light shines toward the center of the dart board 400. Therefore, the front surface of the dart board 400 glows to thereby enhance beauty and the aesthetic sense of the dart board.

The segment receiving board 430 is arranged at the central portion of the number board 420, and is joined with the rear cover 450 through a joining flange 431 outwardly and perpendicularly bent at the rear thereof.

The segment receiving board 430 may contain one selected from a fluorescent pigment, a phosphorescent pigment, and a fluorescent/phosphorescent pigment, in which the fluorescent pigment and the phosphorescent pigment are mixed, by impregnation, coating or other method, and in this instance, the rim cover 410 emits light or self-glows by light emitted through the LED parts 413 mounted along the inner circumference thereof.

The segment receiving board 430 has a plurality of receiving spaces 432 formed therein. For instance, the receiving spaces 432 are twenty first arc-shaped receiving portions 432 formed along the rim of the receiving board 430, twenty second arc-shaped receiving portions 433 formed inside the first receiving portions 432, twenty third arc-shaped receiving portions 434 formed inside the second receiving portions 433, and twenty fourth arc-shaped receiving portions 435 formed inside the third receiving portions 434.

Differently from the above, as illustrated in FIGS. 8, 9, 10 and 12, the segment receiving board 430 may have a plurality of circular receiving portions formed concentrically. So, because the segment receiving board 430 has a form similar to the target board for archery, people can enjoy archery and use the segment receiving board 430 as the target board for archery.

A segment 440 received in each of the receiving spaces 432 of the segment receiving board 430 has a needle hole 441 formed in a thickness direction in such a fashion that a plastic pin 310 of the dart pin 300, which will be described later, can be stuck into the needle hole 441 in the thickness direction.

In this instance, the segment receiving board 430 may contain one selected from a fluorescent pigment, a phosphorescent pigment, and a fluorescent/phosphorescent pigment, in which the fluorescent pigment and the phosphorescent pigment are mixed, by impregnation, coating or other method, and in this instance, the rim cover 410 emits light or self-glows by light emitted through the LED parts 413 mounted along the inner circumference thereof.

The rear cover 450 forms the rear face of the dart board 400, and is screw-coupled to the number board 420.

Moreover, the rear cover 450 is in an approximately flat plate shape, and has a flange part 451, which is outwardly horizontally bent at the rim of the rear cover 450 and gets in close contact with the inner circumferential surface of the number board 420.

Furthermore, the rear cover 450 may further include a joining hole 452 formed on the inner face thereof. The joining hole 452 has a structure of an assembly piece for an easy bolt fixation, such that the number board 420 and the shock absorbing plate 460 can be easily matched with the rear cover 450 because a projection 424 formed on the number board 420 passes through the shock absorbing plate 460 and is fit to the shock absorbing plate 460.

In the meantime, the luminous dart board set (S) according to the present invention may further include another shock absorbing plate 460 mounted on the inner face corresponding to the segment 440 of the rear cover 450.

The shock absorbing plate 460 serves to absorb flexibility (shock) of the dart pin 300 stuck into the segment 440, and it is preferable that the shock absorbing plate 460 is made of one of sponge, styrene foam, cork, and rubber, which are rapidly restored in shape.

As described above, because the shock absorbing plate 460 is arranged on the inner face of the rear cover 450, it can absorb shock and noise generated when the dart pin 300 is bumped against the dart board 400, and hence, it prevents the dart pin 10 from not being attached to the dart board 20 and dropping down.

Moreover, the luminous dart board set (S) according to the present invention may further include a scoring sheet 470 mounted on the inner face of the shock absorbing plate 460, a printed circuit board 480 electrically connected with the scoring sheet 470, and a display part 490 electrically connected with the printed circuit board 480.

The scoring sheet 470 includes: a first electric current sheet 471 having first electric current wires respectively printed thereon and respectively concentrically insulated and sectioned; and a second electric current sheet 472 having second electric current wires, which are printed thereon and respectively radially insulated and sectioned, the second electric current sheet 472 being piled up with the first electric current sheet 471. The scoring sheet 470 may have a film type membrane switch, or may be applied to all means which is switched by shock generated when the dart pin is attached to the dart board.

Unexplained reference numeral 473 designates an insulating plate for insulating the first electric current sheet 471 from the second electric current sheet 472.

Moreover, the printed circuit board 480 further includes a microprocessor 481 for calculating a score value set at a position which is charged with electricity by pressure of the dart pin 300 sensed on the scoring sheet 470 and sending the calculated score value to the display part 490.

When the dart pin 300 thrown by a player is attached to any one point where the first electric current wire of the first electric current sheet 471 and the second electric current wire of the second electric current sheet 472 of the scoring sheet 210 cross each other, the first electric current wire and the second electric current wire get in contact with each other at the point where the dart pin 300 is attached, and hence, the score value of the contact point is transferred to the printed circuit board 480, to which the first electric current wire of the first electric current sheet 471 and the second electric current wire of the second electric current sheet 472 are electrically connected.

Because information on scores corresponding to the combination of the sectioned first and second electric current wires is set in advance, a score value corresponding to a zone (a) located at the point where the dart pin 300 thrown by the player is attached is calculated by the microprocessor 481 of the printed circuit board 480, and it is displayed through the display part 490.

In the meantime, the luminous dart board set (S) according to the present invention may further include: a monitor 510; and a manipulation button 520 for allowing reset or ON/OFF modes of the monitor 510; and a speaker 530 mounted under the manipulation button 520.

In this instance, as shown in FIGS. 21 to 25, the luminous dart board set (S) may have a mounting part for mounting the monitor 510, the manipulation button 520 and the speaker 530 under the dart board 400 or above and under the dart board 400.

Figure 26:
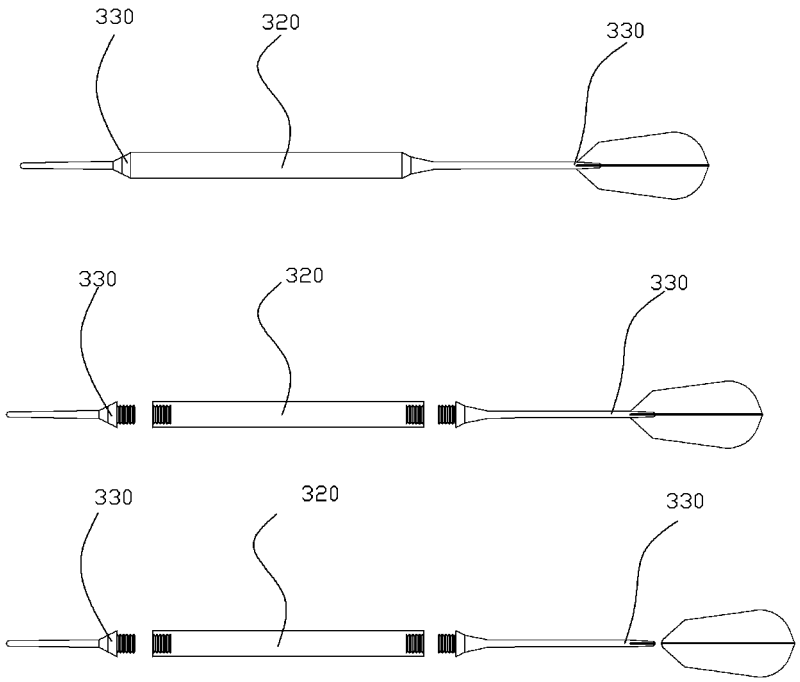
FIG. 26 is a view showing a structure of a dart pin.

Differently from the above, as shown in FIG. 26, the luminous dart board set (S) may include a stand 500 for standing the dart board set, and the dart board 400, the monitor 510, the manipulation button 520 and the speaker 530 are mounted on the stand 500.

In the case of the standing dart board set, besides the LED parts 413 mounted inside the dart board, additional LED parts 413' are formed at both sides of the dart board 400.

Figure 27:
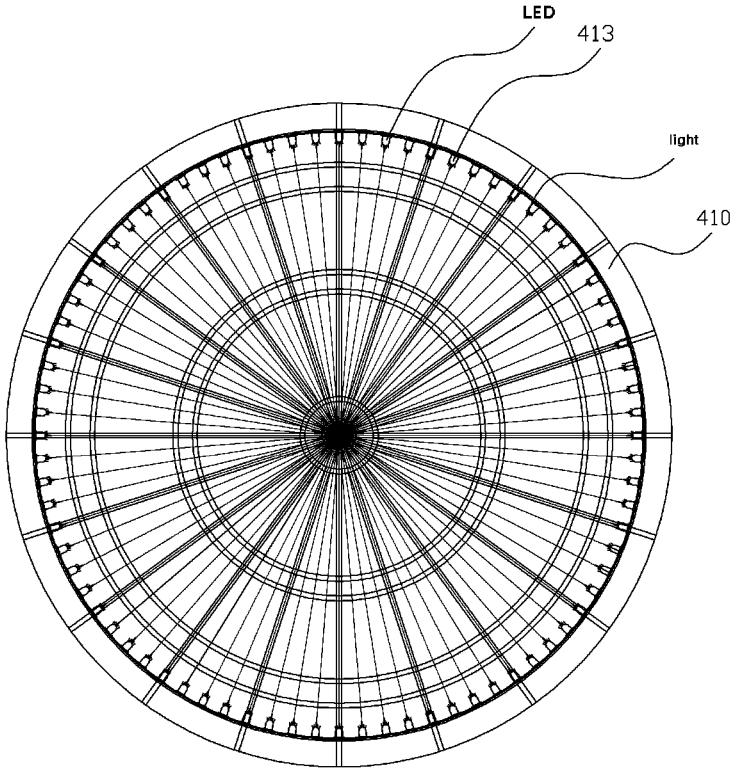
FIG. 27 is a view showing a state where light is emitted from circularly arranged LED parts.

In the meantime, as shown in FIG. 27, the dart board 300 includes: a plastic needle 310 having a sharp tip disposed at the front side; a pin body 320 screw-coupled with the plastic needle 310 and made of metal or plastic; and a dart wing 330 screw-coupled with the rear of the pin body 320.

Here, the plastic needle 310 and the dart wing 330 or the pin body 320 of the dart pin 300 is injection-molded of a plastic material, and the fluorescent pigment is impregnated therein. Therefore, when the fluorescent dart pin 10 is attached onto the front surface of the dart board 20 by light emitted through the LED parts 70, it produces a luminous effect, and hence, a player can easily see the position of the dart pin 10 attached to the dart board 20 even though there is no illumination in a dark space.

While example embodiments of the present invention are capable of various modifications and alternative forms, embodiments of the present device are shown by way of example in the drawings and will herein be described in detail. It should be understood, however, that there is no intent to limit the example embodiments of the present invention to the particular forms disclosed, but on the contrary, the example embodiment of the device is to cover all modifications, equivalents, and alternatives falling within the scope of the present invention.

EXPLANATION OF REFERENCE NUMERALS IN THE DRAWINGS

| | |
|---|---|
| 10: dart pin | 11: magnet |
| 12: dart wing | 20: dart board |
| 21: printing pattern | 22: printed matter |
| 30: body | 31: projecting coupling hole |
| 32: fixing part | 33: reinforcement part |
| 34:: projection | 40: shock absorbing plate |
| 50: rim cover | 51: cover part |
| 52: floodlight space | 53: fixing projection |
| 60: support bracket | 61: piece |
| 70: LED part | 80: luminous band |
| 101: fluorescent pigment | 102: phosphorescent pigment |
| 210: scoring sheet | 211: first electric current wire |
| 212: first electric current sheet | |
| 213: second electric current wire | |
| 214: second electric current sheet | |
| 220: printed circuit board | |
| 230: display part | 240: microprocessor |
| 212a: first scoring section | |
| 212b: second scoring section | |
| 212c: third scoring section | |
| 212d: fourth scoring section | |
| 214a: first grounding section | |
| 214b: second grounding section | |
| 214c: third grounding section | |
| 214d: fourth grounding section | |

-continued

| | |
|---|---|
| 215a: first detection wire | |
| 215b: second detection wire | |
| 215c: third detection wire | |
| 215d: fourth detection wire | |
| 430: segment receiving board | 440: segment |
| 450: rear cover | 460: shock absorbing plate |
| 470: scoring sheet | 480: printed circuit board |
| 490: display part | 500: stand |
| 510: monitor | 520: manipulation button |
| 530: speaker | |

The invention claimed is:

1. A luminous dart board set comprising:

a dart pin (10) having a magnet (11) embedded in the front portion thereof;

a dart board (20) made of either an iron plate or an iron rubber sheet and including a printed matter (22) having a printing pattern (21) on the front surface thereof;

a body (30) including a fixing part (32) coupled to a bottom surface of the dart board (20) and outwardly bent along the circumference thereof, and a reinforcement part (33) perpendicularly bent in an outward direction of the fixing part (32);

a rim cover (50) including a cover part (51) bent along the circumference of the body (30) so as to cover the front surface of the circumference of the body (30), and a floodlight space (52) spaced apart from the cover part (51);

LED parts (70) disposed on the inner face of the rim cover (50) so as to emit light toward the floodlight space (52); and a fluorescent pigment, a phosphorescent pigment, and/or a mixture of the fluorescent pigment and the phosphorescent pigment which is added to at least one of the dart pin (10), the rim cover (50), and the printed matter (22).

2. The luminous dart board set according to claim 1, further comprising:

a shock absorbing plate (40) mounted between the lower face of the printed matter (22) and the upper face of the body (30).

3. The luminous dart board set according to claim 1, wherein width (a) of the fixing part (32) of the body (30) is wider than width (b) of the rim cover (50) mounted along the circumference of the body (30), so that a circular light-emitting band (80) is formed by light of the LED parts (70) emitted through the floodlight space (52) formed by the rim cover (50) along width (c) of the fixing part (32) of the body (30), which is wider than the width (b) of the rim cover (50).

4. The luminous dart board set according to claim 1, further comprising:

a scoring sheet disposed between the dart board (20) and the printing pattern (21) adapted for sensing pressure of the dart pin (10) attached to the dart board (20);

a printed circuit board (220) electrically connected with the scoring sheet (210); and a display part (230) electrically connected with the printed circuit board (220).

5. The luminous dart board set according to claim 4, wherein the scoring sheet (210) comprises:

a first electric current sheet (212) having first electric current wires (211) printed thereon and respectively concentrically sectioned; and a second electric current sheet (214) having second electric current wires (212), which are printed thereon and respectively radially sectioned, the second electric current sheet 214 sensing an electric connection of each section formed by the first electric current sheet (212) and the second electric current sheet (214) crossing each other.

6. The luminous dart board set according to claim 4, wherein the printed circuit board (220) further comprises a microprocessor (240) adapted for calculating a previously set score value corresponding to each section of the scoring sheet (210) and sending the calculated score value to the display part (230).

7. The luminous dart board set according to claim 4, wherein the first electric current sheet (212) of the scoring sheet (210) comprises first to fourth score sections (212*a*, 212*b*, 212*c* and 212*d*) respectively having different scores, and each score section is electrically connected with the other score sections, which have the same score, in a row, wherein the second electric current sheet (214) of the scoring sheet (210) comprises first to fourth grounding sections (214*a*, 214*b*, 214*c* and 214*d*), which are grounded at positions corresponding to the first to fourth score sections (212*a*, 212*b*, 212*c* and 212*d*) of the first electric current sheet (212) by pressure, and each grounding section is electrically connected with the other grounding sections, which have the same score, in a row, and the second electric current sheet (214) has the same arrangement as the first electric current sheet (212), and wherein a score is detected by an electric connection between the first to fourth score sections (212*a*, 212*b*, 212*c* and 212*d*) and the first to fourth grounding sections (214*a*, 214*b*, 214*c* and 214*d*).

8. The luminous dart board set according to claim 7, wherein the first scoring section (212*a*) and the third scoring section (212*c*) of the first electric current sheet (212) are electrically connected with each other by a first detection wire (215*a*), and the second scoring section (212*b*) and the fourth scoring section (212*d*) of the first electric current sheet (212) are electrically connected with each other by a second detection wire (215*b*).

9. The luminous dart board set according to claim 4, wherein the first grounding section (214*a*) and the second grounding section (214*b*) of the second electric current sheet (214) are electrically connected with each other by a third detection wire (215*c*), and the third grounding section (214*c*) and the fourth grounding section (214*d*) are electrically connected with each other by a fourth detection wire (215*d*).

10. A luminous dart board set comprising:

a dart pin (300) having a plastic needle (310) of a sharp tip screw-coupled to the front portion thereof; and a dart board (400) including: a rim cover (410) having a floodlight space (411); a number board (420) assembled inside the rim cover (410); a segment receiving board (430) mounted inside the number board (420) and having a plurality of receiving spaces (431); a plurality of segments (440) received in each of the sectioned receiving spaces (431) of the segment receiving board (430) and each having a needle hole (441) to which the plastic needle (310) of the dart pin (300) is stuck in a width direction; and a rear cover (450) arranged at the rear of the segment receiving board (430), wherein LED parts (413), which emit light toward the floodlight space (412) of the rim cover (410), are arranged on the inner face of the rim cover (410) in a circular form and face the center of the dart board (400).

11. The luminous dart board set according to claim 10, wherein at least one of a fluorescent pigment, a phosphorescent pigment, and a mixture of the fluorescent pigment and the phosphorescent pigment is added to at least one of the dart pin (300), the rim cover (410), the number board (420), the segment receiving board (430), and the segments (440).

12. The luminous dart board set according to claim 10, further comprising:

a shock absorbing plate (460) mounted on an inner face in corresponding to the segments (440) of the rear cover (450).

13. The luminous dart board set according to claim 10, further comprising:

a scoring sheet (470) disposed between the segments (440) and the rear cover (450) adapted for sensing shock generated when the dart pin (300) is stuck into the needle hole (441) of the segment (440) and producing a score;

a printed circuit board (480) electrically connected with the scoring sheet (470); and a display part (490) electrically connected with the printed circuit board (480).

14. The luminous dart board set according to claim 13, wherein the printed circuit board (480) further comprises a microprocessor (481) adapted for calculating a previously set score value corresponding to each section of the scoring sheet (470) and sending the calculated score value to the display part (490).

15. The luminous dart board set according to claim 10, further comprising:

a stand (500) on which the dart board (300) is mounted;

a monitor (510) mounted above the dart board (400) of the stand (500) adapted for outputting a dart score; and a manipulation button (520) mounted under the dart board (400) of the stand (500) adapted for allowing reset or ON/OFF modes of the monitor (510); and a speaker (530) mounted under the manipulation button (520).

16. The luminous dart board set according to claim 10, wherein the sectioned spaces (431) of the segment receiving board (430) are concentrically and/or radially sectioned into equal parts.

* * * * *